US006745498B2

(12) United States Patent
LaDuca

(10) Patent No.: US 6,745,498 B2
(45) Date of Patent: Jun. 8, 2004

(54) HIGH-HEELED JAZZ DANCING AND CHARACTER DANCING SHOE

(76) Inventor: Phillip F. LaDuca, 534 Ninth Ave., Apt. 1R, New York, NY (US) 10018

( * ) Notice: Subject to any disclaimer, the term of this patent is extended or adjusted under 35 U.S.C. 154(b) by 57 days.

(21) Appl. No.: 10/241,956

(22) Filed: Sep. 11, 2002

(65) Prior Publication Data

US 2004/0045191 A1 Mar. 11, 2004

(51) Int. Cl.[7] ..... A43B 5/12
(52) U.S. Cl. ..... 36/8.3; 36/108; 36/103
(58) Field of Search ..... 36/8.3, 97, 103, 36/108, 76 R, 72 A, 148, 149, 34 A

(56) References Cited

U.S. PATENT DOCUMENTS 1,553,196 A * 9/1925 Lola ..... 36/8.3
1,652,034 A * 12/1927 Mayers ..... 36/169
2,093,354 A * 9/1937 Grinde ..... 36/34 R
2,303,431 A * 12/1942 Brophy ..... 36/11.5
2,912,772 A * 11/1959 Harrison ..... 36/108
2,970,389 A * 2/1961 Pervis ..... 36/108
5,410,820 A * 5/1995 Goodman ..... 36/25 R
5,416,989 A * 5/1995 Preston ..... 36/108
5,682,685 A * 11/1997 Terlizzi ..... 36/8.3
5,956,868 A * 9/1999 Stevens et al. ..... 36/8.3
5,996,251 A * 12/1999 LaDuca ..... 36/8.3

* cited by examiner

*Primary Examiner*—Jila M. Mohandesi
(74) *Attorney, Agent, or Firm*—Steven Horowitz

(57) ABSTRACT

A high-heeled dancer's shoe providing the structural integrity to prevent bowing and to execute energetic character dancing steps and simultaneously maintaining the flexibility necessary to execute jazz steps. The shoe comprises a front sole support made of hard rubber with a predetermined tensile strength or of fabric cushioning, the front sole support spanning a length and width of an area of a front sole, a hard plastic high heel, a metal shank extending from a back of the shoe and entirely covering the heel and forward over the arch in a middle portion of the shoe, and a shoe body including a flexible shoe upper shaped for receiving the dancer's foot, including left and right sides that have an elastic insert above in an area of an arch, and a continuous layer of leather spanning a length and width of the shoe.

26 Claims, 3 Drawing Sheets

HIGH-HEELED JAZZ DANCING AND CHARACTER DANCING SHOE

The present invention relates to footwear designed to have the versatility to be used in diverse dance styles, in particular in jazz dancing and character dancing.

Jazz dancing is a flexible free form of dancing that requires soft, pliable manipulation of the feet and toes including the dancer pointing the foot for aesthetic effect. Ballet, while it is a rigidly stylized dance form, also involves soft, pliable manipulation of the foot for aesthetic effect.

Character dancing or folk dancing, in contrast to jazz dancing and ballet, involves energetic steps, including brushing, gliding, jumping and turning as well as stomping, kicking, scuffing, slamming and clicking. One can imagine such steps as part of energetic movements in typical well known Broadway musical plays such as Chorus Line or West Side Story. Tap dancing, which involves tapping steps by dance shoes containing taps, may be thought of as a kind of American folk dancing.

As a result of these differences in dance styles, there are corresponding differences in the footwear needed by dancers that are dancing in these styles. For example, the dance shoes needed for jazz dancing have soft soles and soft shoe uppers in order to provide sufficient flexibility to the dancer's foot. Ballet dance slippers, worn by male or female dancers to go three quarters on pointe (called "three quarter releve"), are soft as well while ballet point dance shoes are worn by female dancers to go fully on pointe (called "on toe") and have a stiff shoe support box at the front of the shoe to allow the dancer to go on pointe but the remainder of the shoe is very soft and flexible. There are also jazz dancing sneakers that have reinforced toe sections that permit the dancer to stand on pointe.

In contrast to the footwear used by jazz dancers, the existing dance shoes used for character dancing have hard leather soles, hard leather heels and firm, strong shoe uppers so that the dance shoe can provide the support and strength needed to perform energetic dance steps used in character dancing like stomping, kicking, scuffing, slamming and clicking. Dance shoes used by character dancers are designed to give support to the dancer; however they do not provide flexibility. Also, they do not allow the dancer to comfortably stand on pointe or even three quarters on pointe and in fact if a dancer wearing such shoes did stand on pointe or three quarters on pointe that dancer would probably be placing a great strain on the dancer's foot. The result would be awkward and possibly harmful over the long run. It would also be awkward and difficult for a dancer wearing dance shoes used in character dancing to dance jazz dancing steps, which requires pliable manipulation of the feet and toes.

The problem inherent is a desire to perform in various dance styles in a single set of shoes has become exacerbated in recent years by the growing sophistication of Broadway sets. More sophisticated sets mean heavier sets, and heavier sets mean thicker stage floors to support them, and thicker stage floors mean less resilient stage floors which are less forgiving to dancers. This has resulted in an increase in the incidence of bruised feet from using shoes which were not exactly adapted to the job. It is known that certain character dance shoes have been used by dancers performing specifically in musical theater and dance concerts for both character dancing and jazz dancing, although such shoes are really not suitable for both styles.

Over the past thirty years, the American Musical has evolved from singular styled presentations, e.g. "The King and I", "Hello Dolly" and South Pacific", often set in one time period and locked into that form of costume and shoes, into diverse spectaculars incorporating all styles and periods in one show, namely ballet, jazz, character and tap. Some examples are "Fosse", "Contact" and Jerome Robbins' Broadway.

The sets have become high-tech, the costumes made of newer and stronger fabrics, the lights are computerized, and the stages have become reinforced for flying chandeliers, helicopters and barricades. However, up to now, the dance shoes have not evolved along with everything else.

The design of the present invention developed as a result of the demand put on the dancer to dance various styles not only in the same show, but also in the same number. The design of the present invention was necessitated by the requirement to be able to perform jumps, leaps, brushes, and glides, to point the feet and straighten the leg to show ballet lines, and then kick, turn or stomp the very next count of music in a fashionable, esthetic high heel, which is pleasing to the line.

A significant advance in this field was disclosed in U.S. Pat. No. 5,996,251 to LaDuca (the '251 patent), incorporated herein in total by reference. A combination jazz dancing and character/tap dancing shoe was disclosed which combined the flexibility of a jazz dancing shoe and the support strength of a shoe used for character/tap dancing. This was achieved by use of a semi-flexible arch made of rubber of specified material properties extending between a hard leather heel and hard rubber fore sole or front sole in combination with an upper including flexible inserts on the sides above the arch.

This shoe combines the support necessary to perform energetic character dancing steps including stomping, kicking, scuffing, slamming and clicking, while maintaining sufficient flexibility to allow the dancer to go either three-quarters en pointe ("flexing") or fully en pointe ("pointing"). Wearable by either male or female dancers the shoe has the overall appearance of a sophisticated street shoe with a heel of between 1" and 1½" in height. This would not normally be described as a "high heel" shoe, and hence there is a need for a high-heeled dance shoe which shared some of the same advantages.

Flat or lower heeled shoes keep the dancer grounded and balanced. However, this look does not coincide with the new musical theatre/chorus girl look of high heels of 2 to 4 inches in height. With the choreography becoming more demanding, dancers still need a strong supportive shoe found in character shoes and at the same time must perform supple and lyrical dance steps associated with pliable shoes for jazz ballet.

Danseuses in particular might wish to perform in a shoe which had the appearance of a feminine high-heel shoe, and particular one which would allow them to perform flexing and pointing and other movements encountered in jazz dancing. They would also like to have such a shoe which provided the support required to perform at least some character dancing steps. Prior art high-heel dancing shoes have a full length metal shank which is completely inflexible, and thus would be unusable for movements including flexing or pointing, or other supple and pliable motions of the foot, although the shank does provide support. On the other hand, in order to increase the flexibility of high-heel dance shoes the design of the '251 patent cannot simply be extended without modification to high-heels, because higher heel shoes require additional structural support of a shank to prevent "bowing", which is the unwelcome severe bending of the middle part of the shoe, sometimes to the point of collapse. The use of a shank militates against maintaining the flexibility for a jazz dancing shoe. Therefore there is a need for a women's high heel dancing shoe which is structurally stable enough for performing character dancing steps, yet flexible enough for pointing and flexing; seemingly contradictory structural requirements for which there is no obvious solution. In particular there is a need for such a shoe that one can use without taps to perform such steps as brushing, gliding, jumping and turning.

SUMMARY OF THE PRESENT INVENTION

In brief summary, the dance shoe of the present invention is designed specifically both for jazz dancing and for character dancing, although not the character dance steps a dancer takes while wearing taps such as stomping, kicking, scuffing, slamming and clicking. To this aim, the dance shoe of the present invention is able to combine the flexibility of a jazz dancing shoe with the support and strength of a shoe used for character dancing, and in particular, a high-heel character shoe. This result is achieved by carefully controlling and targeting to specific locations the tensile strength and stiffness of the elements of the shoe. This new combination shoe has a rigid half metal or hard leather shank extending forward from the heel, which provides strength and support necessary to permit the dancer to perform at least some steps in a character dancing style, combined with either a front sole support made either of rubber of specified resiliency or of a fabric cushion, the front sole support being for padding and protecting the ball of the foot. Adjoining the shank and the front sole support is a single layer of leather or suede extending the length and width of the shoes, and forming the outer sole. The hard rubber or fabric cushion front sole support provides cushioning and support for the toes, while the intervening region of sole formed solely by the bridging leather outer sole creates a bridge between the half-shank and hard rubber front sole flexible enough to flex and point. The flexibility is further aided by a pair of elastic inserts or gussets in the sides of the shoe above the arch.

It is not contemplated that in a high-heel character shoe a dancer will perform the most energetic and "folksy" character dancing steps; such as stomping, kicking, scuffing, slamming and clicking; however it is contemplated that a dancer may dance in the recognized character dancing style, including energetic brushing, gliding, jumping and turning, as well as jazzy pointing and flexing, but with the body weight more forward and on the ball of the foot than in jazz dancing, emphasizing the line of the leg.

OBJECTS OF THE INVENTION

The following important objects and advantages of the present invention are:

(a) to provide a high-heeled dancer's shoe having the flexibility required for jazz dancing steps as well as the support and strength required for character dancing steps such as brushing, gliding, jumping and turning, (b) to provide a dance shoe that targets the hardness or stiffness for each part of the shoe so as to achieve both flexibility and strength, (c) to provide a high-heeled dancer's shoe which permits the dancer to both flex and to stand three quarters pointe easily and comfortably, (d) to provide a high-heeled dancer's shoe which has sufficient stiffness in an arch section to prevent bowing of the shoe, (f) to provide a dance shoe that is suitable to be worn by dancers who wish to perform in cross-over roles combining the techniques of jazz and character dancing.

DETAILED DESCRIPTION OF THE DRAWINGS

Figure 1:
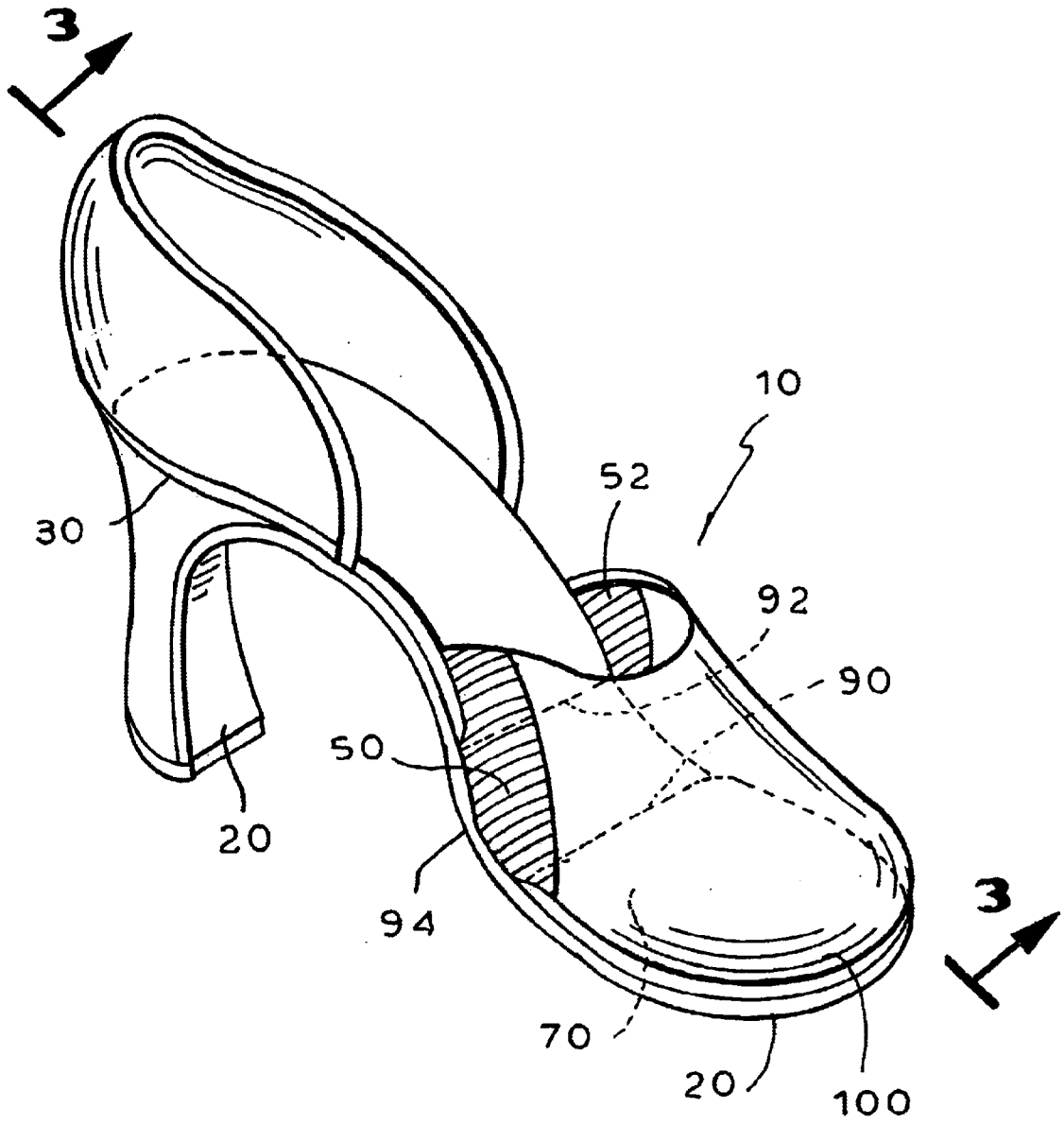
FIG. 1 is a perspective view of the shoe of the present invention.

In order to better understand the present invention in conjunction with the drawings of FIGS. 1–3, the dance shoe of the present invention is assigned reference numeral 10 and its elements are described and assigned the reference numerals identified below.

Figure 2:
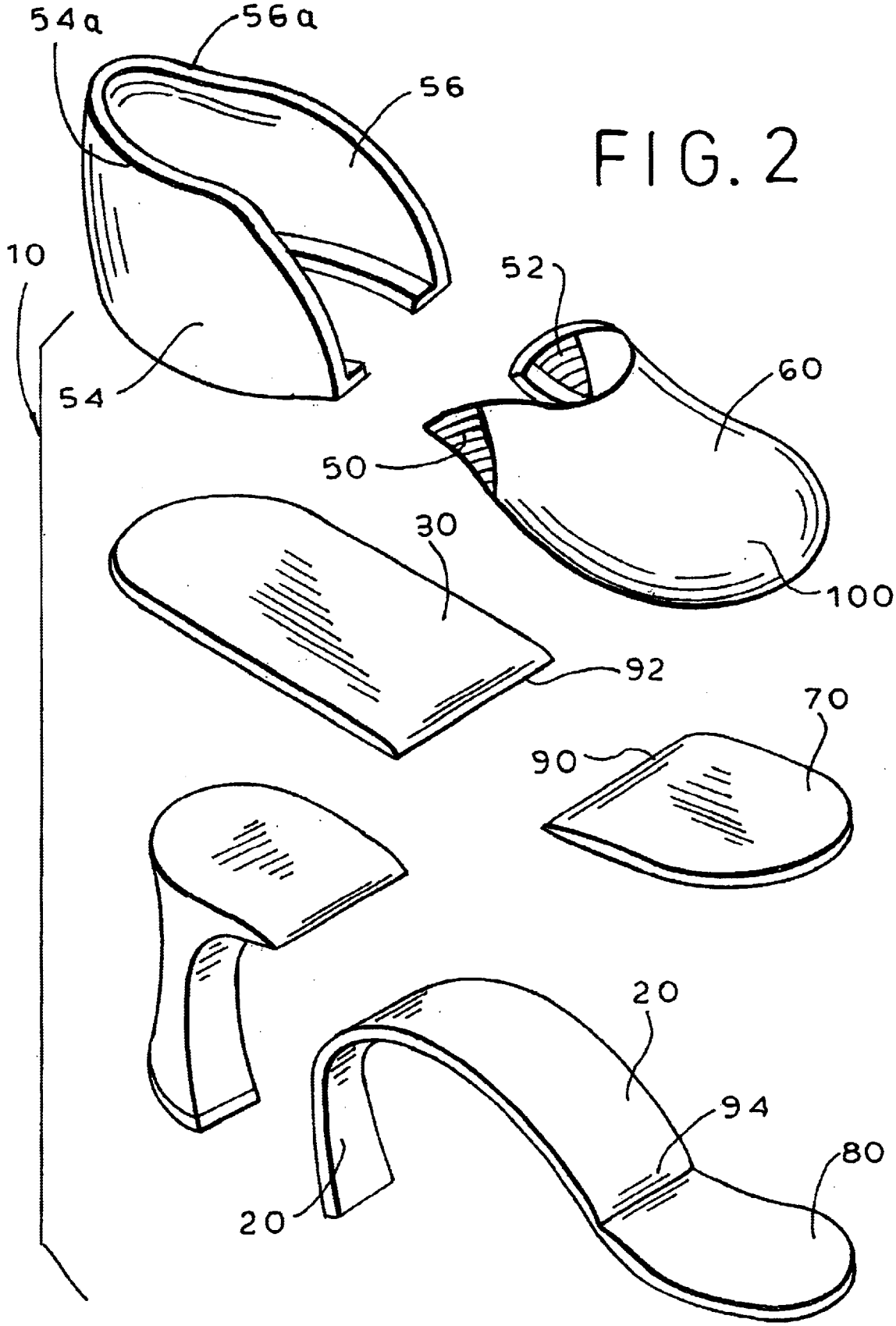
FIG. 2 is an exploded perspective view of FIG. 1.

FIG. 2 depicts the unassembled elements of shoe 10 in exploded perspective. The shoe body (not separately designated) includes shoe upper 60 and shoe bottom or outer sole 20. Shoe upper 60 itself may be made of standard flexible leather or other suitable materials but it includes flexible elastic inserts 50, 52 sewn into each side 54, 56 of the shoe upper 60 respectively, preferably above the area of the arch or middle section of the shoe forward of the heel, corresponding to the natural arch of the foot.

Shown separately is the continuous leather layer or outer sole 20 extending the width and length of the shoe 10. High heel 40 and rigid half shank 30 are also shown below and above leather layer 20 respectively. Finally, a front sole support 70 is positioned between a front portion 20*a* of outer sole 20 and a front portion of shoe upper 60. Front sole support 70 is either hard rubber and/or is made of a fabric cushion from well known fabric materials such as cotton or polyester. If front sole support 70 included both hard rubber layer and a fabric cushion layer then the fabric cushion layer would be on top of the hard rubber layer. Together, shank 30, front sole support 70 and leather outer sole 20 comprise a composite sole for the shoe. The arch of the shoe is that area substantially contiguous with that portion of the shank which is not directly over the heel in the embodiment shown in the drawings, and is intended to be understood in the ordinary sense of the shoemaker's art.

Additional inner sole components (not shown), such as a felt or padded insert running the length and breadth of an interior bottom of the shoe body, or a rigid heel cup over the region of the high heel and the shank, may be optionally inserted in a manner widely known in the shoemaking.

Front sole support 70, to the extent it is made from hard rubber, is preferably made from shard rubber with a tensile strength of between 5 and 9 Newtons per square millimeter. The unit "newtons per square millimeter" will be abbreviated "N/mmq", and also has the common name "megaPascal" (Mpa). If front sole support is made from cushioning fabric its tensile strength would be significantly lower.

FIG. 1 is a perspective view of completed dance shoe 10 showing the assembled components of FIG. 2. Flexible inserts 50, 52 are located on side 54, 56 of the shoe upper 60. Each of the flexible inserts 50, 52 is made of an elastic stretch material. Inserts 50, 52 typically run from top edges 54*a*, 56*a* of each side 54, 56 of the shoe upper 60, and to be effective in enhancing flexibility should cover most of the height of the sides 54, 56 of the shoe upper 60.

Attached to shoe upper 60 in the primary embodiment is a continuous leather layer or outer sole 20 which extends from a vicinity of the toe 80 to a rear edge of high heel 40, that it forms a continuous layer that runs the length and breadth of the shoe, extending over heel 40. The continuous outer sole 20 bridges a gap defined by a rearward edge 90 of front sole support 70 and a forward edge 92 of rigid shank 30, and forms the only component of the composite sole (outer sole, front sole support, shank) in this region with the possible exception of an inner sole insert. The composite sole thus has a hinge section between a rear section of the shoe supported by rigid shank 30 and a front section of the shoe underpinned by the hard rubber sole support 70, the hinge bridged only by flexible outer sole 20 and optionally a flexible inner sole and creating a region of sufficient pliability for the execution of pointing and flexing.

High heel 40 is made typically of hard plastic having a cover that is made of leather, satin, cloth fabric or other similarly suited material. High heel 40 is between approximately two inches and four inches in height. In certain preferred embodiments, high heel 40 is between approximately two and one half and approximately three inches in height.

While the preferred tensile strength of front sole support 70, when made of hard rubber, is approximately 6 newtons per square millimeter, "newtons per square millimeter" being denoted herein as "N/mmq", it is believed that the tensile strength of hard rubber sole support 70 can vary from between approximately 5 newtons per square millimeter or 5 N/mmq to approximately 8 or 9 N/mmq and still maintain the advantages of the present invention. (The unit "N/mmq" is also commonly known as a MPa ("megapascal") in the SI system of scientific units).

In certain embodiments leather layer or outer sole 20 does not run the length and width of the shoe 10, but at a minimum it must bridge the gap between edges 90 and 92 to create the desired hinge in the composite sole. Preferably the outer sole extends from a front edge 42 of the high-heel to toe region 80, simplifying manufacture and conferring additional structural integrity to the shoe. Most preferably outer sole 20 extends the length and breadth of the shoe from the toe region back to and covering the entire upper surface of the heel. This arrangement is simplest of manufacture and the outer sole thereby maximally aids in providing structural integrity and maintaining the shape of the overall shoe.

The flexibility or stiffness of continuous leather layer or outer sole 20 may be specifically targeted to specific regions of the shoe. For example, the continuous layer may include a stiff hard leather front region in an area of the front sole and beneath front sole support 70, a thin flexible middle region of the hinge and a stiff hard leather back region above heel 40. In this context the "middle region" of the leather is not to be confused with the middle section of the shoe, as described above and substantially corresponding to the arch. The middle region of the leather sole in embodiments with varying stiffness in the leather sole occurs in a region forward of the arch and just rear of the forward sole support. This middle region is the region of the sole having maximum flexibility.

Variations in stiffness in the sole may be achieved by variations in the thickness of the leather achieved by well known means including shaving off the thickness of leather having a particular thickness, by selective chemical treatment, or by bonding of separate pieces of leather. A variation in thickness may be achieved by compression of the leather by rollers in the region to become the hinge, thus maintaining much of the tensile strength and resiliency of the full thickness of leather, while enhancing flexibility.

As noted the front sole support 70 may be made of fabric cushioning. This will naturally confer yet greater flexibility and suppleness on a toe region of the shoe, while reducing the padding. The inclusion of front sole support 70 made of hard rubber in general confers an advantage over the prior art of cushioning and stabilizing the foot within a high-heeled shoe used for dancing. The prior art includes ad-hoc stuffing of foam rubber or silicon "gel-pacs" into the toe box (region of the shoe containing and stabilizing the dancer's toes). In addition to possibly being uncomfortable and having characteristics irreproducible from use to use, stuffing tends to distort the shoe upper, and destroy the integrity of the look, structure and fit of the shoe. FIG. 3 represents a side elevation view of the completed shoe. Hinge region 94 may be seen partially flexed upward in conformance with placement of the shoe on a floor F under the weight of the dancer (not shown), distributing weight between a region of the front sole support 70 and high heel 40. The dancer can raise the heel and put the full body weight on the ball of the foot (three-quarters pointe or flexing) further bending the hinge 94 in an upward direction, or alternatively can cause hinge 94 to flex in a reverse direction, and a resulting extension of an upper portion of the shoe to be accommodated by elastic inserts 50, 52. It will thus be clear that while the dancer's shoe 10 provides the arch support of shank 30, preventing bowing of the shoe in the ordinary standing position with two points of support on the floor, the shoe possesses the ability to bend either toe down or toe up in response to the dancer's needs without placing undo tensile stress on any portion of the shoe, or a resulting additional stress on the dancer's foot tending to oppose fluid movement.

Figure 3:
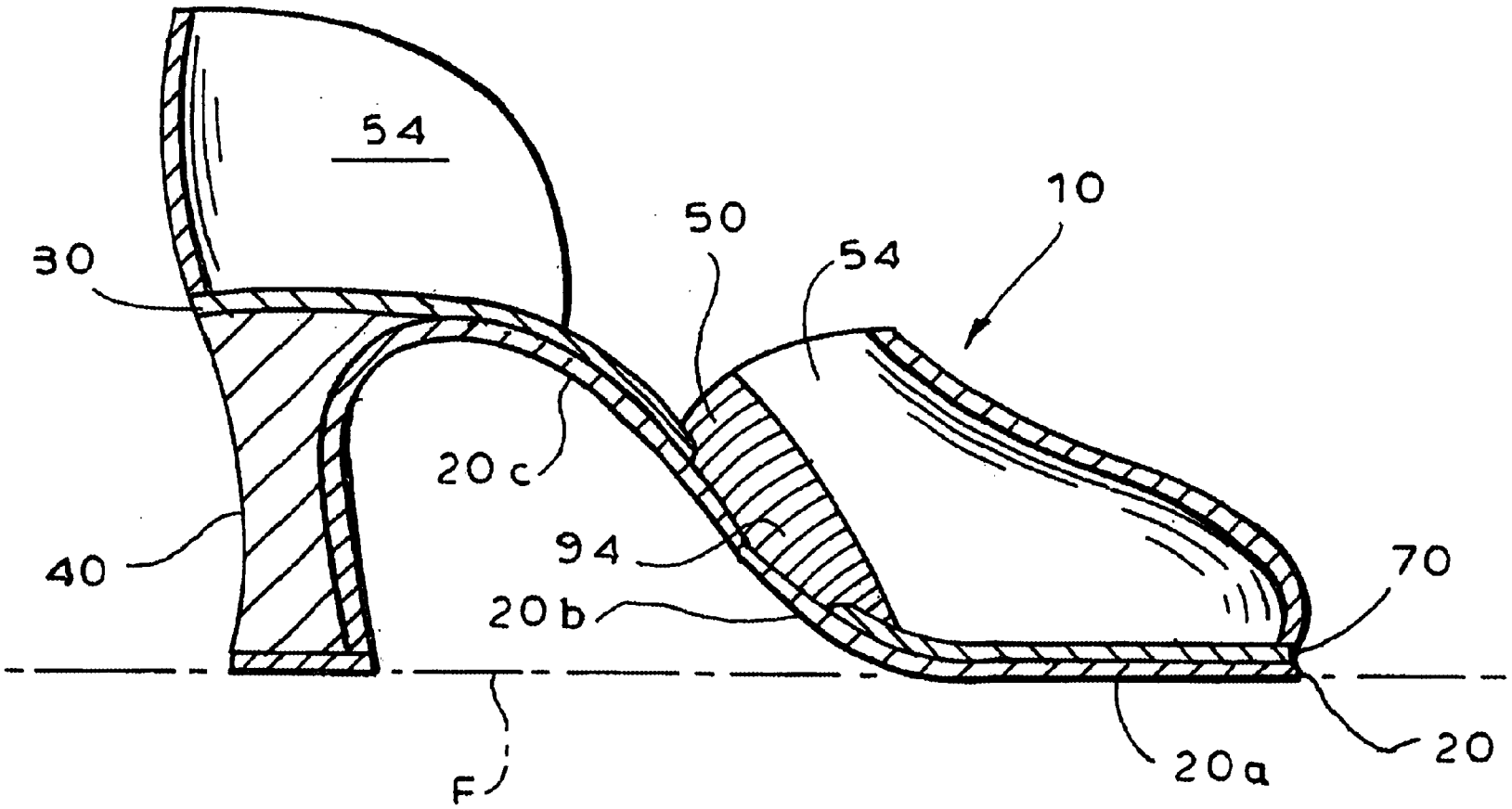
FIG. 3 is a cross sectional view taken along line 3—3 of FIG. 1.

As seen from FIGS. 1 and 3, it will be understood that in a region of hinge 94 (here corresponding to a region of more flexible leather, 20*b*) the overall composite sole, comprising outer sole, front sole support and shank, is thinner than elsewhere. Accordingly, there will be a dip or depression in at least one of the upper and lower surfaces of the composite sole. The depression is portrayed as inside the shoe body, adjacent to the dancer's foot. It will be recognized in this way that the depression is adapted to conform to a lower surface of the foot, or is filled with a suitable soft-foam support (not shown) which will not significantly lower the flexibility of hinge 94.

It will be understood for the purposes of this application that "suede" is known to be a form of leather. It will also be understood that when "leather" is mentioned, any similar natural or artificial material may be understood, such as vinyl plastic.

It will also be understood by those skilled in shoemaking that various aspects of the shoe, such as provision of a thin lip of material running around an inside lower edge of the upper, to facilitate an attachment to the elements of the sole, such as would be obvious to a practitioner building the shoe from these specifications, have been omitted for clarity. It is to be further understood that while the apparatus of this invention has been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A dancer's shoe that has the flexibility required for jazz dancing and for standing three-quarters on pointe and the support strength required for character dancing, comprising:

a front sole support made of hard rubber that has a tensile strength of between approximately 5 and approximately 9 N/mmq, said front sole support spanning a length and width of an area of a front sole, a hard plastic high heel, said high heel being at least approximately two inches in height at all parts of the high heel, a shoe body including a flexible shoe upper shaped for receiving the dancer's foot, said shoe upper including a left side that has a an elastic insert in an area of an arch and a right side that has an elastic insert in the area of the arch, a continuous layer of leather spanning a length and width of the shoe, said layer including a stiff hard leather front region in an area of the front sole beneath the front sole support, a thin flexible leather middle region just behind the front sole support and a stiff hard leather back region extending over the heel; and a rigid shank extending from a back of the shoe and entirely covering the heel and further extending forward over the arch in a middle portion of the shoe and terminating before the front sole support, said shank preventing bowing of the shoe;

the shoe providing strength and support for energetic dancing but still allowing a wearer to flex the shoe and to stand three-quarters pointe during dancing.

2. The dancer's shoe of claim 1, wherein each elastic insert runs from a top of each side of the shoe upper and extends until just above the arch support.

3. The dancer's shoe of claim 2, wherein the heel is between approximately 2 inches in height and approximately 4 inches in height.

4. The dancer's shoe of claim 3, wherein the heel is between approximately 2½ inches and approximately 3 inches in height.

5. The dancer's shoe of claim 2, wherein the shank is metal.

6. The dancer's shoe of claim 5, wherein the heel is between approximately 2 inches and approximately 4 inches in height and wherein the heel is made of hard plastic.

7. The dancer's shoe of claim 6, wherein the hard plastic is covered with material selected from the group consisting of leather, satin and cloth fabric.

8. The dancer's shoe of claim 6, wherein the heel is between approximately 2½ inches and approximately 3 inches in height.

9. The dancer's shoe of claim 2, where the shank is hard leather.

10. The dancer's shoe of claim 8, wherein the heel is between approximately 2 inches and approximately 4 inches in height.

11. The dancer's shoe of claim 10, wherein the heel is between approximately 2½ inches and approximately 3 inches in height.

12. The dancer's shoe of claim 1, wherein the hard rubber in the front sole support has an additional layer of fabric cushioning above it.

13. A dancer's shoe that has the flexibility required for jazz dancing and for standing three-quarters on pointe and the support strength required for character dancing, comprising:

a front sole support made of cushioning fabric, said front sole support spanning a length and width of an area of a front sole, a hard plastic high heel, said high heel being at least approximately two inches in height at all parts of the high heel, a shoe body including a flexible shoe upper shaped for receiving the dancer's foot, said shoe upper including a left side that has a an elastic insert in an area of an arch and a right side that has an elastic insert in the area of the arch, a continuous layer of leather spanning a length and width of the shoe, said layer including a stiff hard leather front region in an area of the front sole beneath the front sole support, a thin flexible leather middle region just behind the front sole support and a stiff hard leather back region extending over the heel; and a rigid shank extending from a back of the shoe and entirely covering the heel and further extending forward over the arch in a middle portion of the shoe and terminating before the front sole support, said shank preventing bowing of the shoe;

the shoe providing strength and support for energetic dancing but still allowing a wearer to flex the shoe and to stand three-quarters pointe during dancing.

14. A high heel dancer's shoe, combining the support necessary for character dancing with the flexibility required for jazz dancing, comprising:

a rigid high heel, of at least approximately 2 inches in height;

a leather outer sole, running the breadth of the shoe from at least a front edge of said high heel forward;

a hard rubber front sole support of tensile strength of between approximately 5 N/mmq and 9/mmq above a front portion of said outer sole;

a rigid half shank mounted above the heel and extending forward in a direction of said front sole support, spanning an arch of said dancer's shoe and terminating before the front sole support; and a flexible shoe upper joined to said outer sole to form a shoe body shaped for receiving a dancer's foot, said shoe upper including a left side that has an elastic insert and a right side that has an elastic insert;

wherein the outer sole spans a gap between the shank and the fore sole, giving the shoe a flexibility in that region sufficient for executing pointing and flexing, while maintaining the rigid arch support of the half-shank and the cushioning of the rubber front sole.

15. The dancer's shoe of claim 14, wherein the elastic insert runs from a top of each side of the shoe upper and extends until just above the outer sole.

16. The dancer's shoe of claim 14, wherein the heel is made of hard plastic that is covered.

17. The dancer's shoe of claim 16, wherein the hard plastic is covered by material selected from the group consisting of leather, satin and cloth fabric.

18. The dancer's shoe of claim 14, wherein the outer sole is suede leather.

19. The dancer's shoe of claim 14, wherein the outer sole extends over a top of the heel to the full length of the shoe.

20. The dancer's shoe of claim 14, wherein the heel is between approximately 2 inches and approximately 4 inches in height.

21. The dancer's shoe of claim 19, wherein the heel is between approximately 2½ inches and approximately 3 inches in height.

22. The dancer's shoe of claim 21, wherein the heel is hard plastic.

23. The dancer's shoe of claim 22, wherein the outer sole extends over a top of the heel to the full length of the shoe.

24. The dancer's shoe of claim 14, wherein the hard rubber in the front sole support has a layer of fabric cushioning above it.

25. A high heel dancer's shoe, combining the support necessary for character dancing with the flexibility required for jazz dancing, comprising:

a rigid high heel, of at least approximately 2 inches in height;

a leather outer sole, running the breadth of the shoe from at least a front edge of said high heel forward;

a front sole support made of fabric cushioning that is located above a front portion of said outer sole;

a rigid half shank mounted above the heel and extending forward in a direction of said front sole support, spanning an arch of said dancer's shoe and terminating before the front sole support; and a flexible shoe upper joined to said outer sole to form a shoe body shaped for receiving a dancer's foot, said shoe upper including a left side that has an elastic insert and a right side that has an elastic insert;

wherein the outer sole spans a gap between the shank and the fore sole, giving the shoe a flexibility in that region sufficient for executing pointing and flexing, while maintaining the rigid arch support of the half-shank and the cushioning of the rubber front sole.

26. A dancer's shoe that has the flexibility required for jazz dancing and for standing three-quarters on pointe and the support strength required for character dancing, comprising:

a front sole support made of cushioning fabric and spanning a length and width of an area of a front sole, a hard plastic high heel, said high heel being at least approximately two inches in height at all parts of the high heel, a shoe body including a flexible shoe upper shaped for receiving the dancer's foot, said shoe upper including a left side that has an elastic insert in an area of an arch and a right side that has an elastic insert in the area of the arch, a continuous layer of leather spanning a length and width of the shoe, said layer including a stiff hard leather front region in an area of the front sole beneath the front sole support, a thin flexible leather middle region just behind the front sole support and a stiff hard leather back region extending over the heel; and a rigid shank extending from a back of the shoe and entirely covering the heel and further extending forward over the arch in a middle portion of the shoe and terminating before the front sole support, said shank preventing bowing of the shoe;

the shoe providing strength and support for energetic dancing but still allowing a wearer to flex the shoe and to stand three-quarters pointe during dancing.

* * * * *